United States Patent [19]

Galosky et al.

[11] Patent Number: 4,887,674

[45] Date of Patent: Dec. 19, 1989

[54] CARTRIDGE OPERATED FIRE EXTINGUISHER

[76] Inventors: David G. Galosky, 8205 Hammond Branch Way, Laurel, Md. 20707; Victor R. Lougheed, 8705 Rooper Rd., Baltimore, Md. 21234

[21] Appl. No.: 171,796

[22] Filed: Mar. 22, 1988

[51] Int. Cl.[4] ..... A62C 37/22

[52] U.S. Cl. ..... 169/61; 169/65; 169/26

[58] Field of Search ..... 169/26, 56, 60, 61, 169/65; 222/5; 239/309

[56] References Cited

U.S. PATENT DOCUMENTS

| | | | |
|---|---|---|---|
| 1,933,694 | 11/1933 | Allen et al. | 169/26 X |
| 2,441,011 | 5/1948 | Dodelin | 169/26 X |
| 3,128,653 | 4/1964 | Service et al. | 60/634 |
| 3.266,669 | 8/1966 | Vuyosevich | 222/5 |
| 3,653,443 | 4/1972 | Dockery | 169/61 |
| 3,866,687 | 2/1975 | Banner | 169/26 X |
| 3,993,138 | 11/1976 | Stevens | 169/61 |
| 4,027,302 | 5/1977 | Healey | 169/61 |
| 4,256,181 | 5/1981 | Searcy | 169/65 |
| 4,270,613 | 6/1981 | Spector | 169/61 |
| 4,671,362 | 6/1987 | Odashima | 169/26 X |

FOREIGN PATENT DOCUMENTS

| | | | |
|---|---|---|---|
| 3036140 | 7/1981 | Fed. Rep. of Germany | 169/19 |

*Primary Examiner*—Sherman D. Basinger
*Assistant Examiner*—Stephen P. Avila
*Attorney, Agent, or Firm*—Michael W. York

[57] ABSTRACT

Fire extinguisher apparatus that is operated by the force of a cartridge such as that used in a nail gun. The cartridge operated fire extinguisher has two detectors that are activated by two separate types of emissions that are characteristic of a fire. Both of these detectors must be simultaneously activated in order for the fire extinguisher apparatus to be operated by the cartridge. The fire extinguisher apparatus also is capable of shutting off electrical equipment such as stoves.

8 Claims, 3 Drawing Sheets

CARTRIDGE OPERATED FIRE EXTINGUISHER

BACKGROUND OF THE INVENTION

There is currently and there has been for some time a need for a simple, comparatively inexpensive reliable fire extinguisher that operates automatically when there is a fire. To be effective such an extinguisher needs to be sensitive enough to be operated during the initial stages of a fire in order to effectively extinguish the fire and to avoid any substantial fire damage. Unfortunately, such systems in the past that were sensitive enough to detect a fire in its very initial stages were also prone to activation when there was no fire. For instance, many such systems could be falsely activated by heat even though there was no actual fire.

This, of course, placed severe limitations on the types of environments in which the system could be utilized. For instance, such systems could not be practically used in environments where there was high heat or open flame or worse yet both high heat and open flame. This later situation exists in many kitchens when cooking is taking place. This combination of high heat and open flame makes it very difficult to provide a fire extinguishing system that is practical which can operate in such an environment.

A system that can be falsely activated is at best inconvenient since the system must be reset so that it can be activated again. In addition, many systems must be recharged or the like so that they can supply a suitable fire extinguishing media. This means that such systems are inoperable for a period of time after they have been used. An improperly activated fire extinguisher system can also result in property damage such as by a fire extinguisher chemical getting into food or machinery. This also requires appropriate cleaning in the vicinity of the extinguishing system. In addition, an improperly activated system can result in the need for a place of business to be temporarily closed while the system is being reset and or reconditioned.

Of course, the consequences of a fire extinguisher system failing to operate can be as bad, or even much worse, than a system that operates prematurely. A system that fails to operate can result in serious property damage and even death. The consequences tend to be worse if the fire extinguishing system is in a location where a fire is likely to go undetected for some period of time.

Fire extinguishing systems in the past have also been liable to degrade in their reliability with time and hence have required periodic checking and maintenance. Most fire extinguishing systems use some type of valve apparatus and valve activation apparatus and this apparatus can degrade with time and is difficult to check and maintain.

This invention overcomes these problems associated with previous fire extinguisher systems. This invention is sensitive and able to detect the initial stages of a fire and yet it is not subject to false activation even when it is in an adverse environment. It is also simple and reliable and its reliability does not degrade significantly with time.

With this invention the extinguishing action is initiated if a fire is sensed simultaneously by a temperature sensor and a light sensor. Detection of an abnormally high light or infrared radiation level is considered sufficient evidence of a fire. Since cooking stoves typically emit considerable heat, detection of high temperatures alone is not satisfactory for identifying a fire condition.

A need for fire detection and automatic suppression exists in all homes, but is particularly useful in units inhabited by the handicapped and elderly. This automatic fire extinguisher accomplishes its task without human intervention and not only warns of a danger but actively neutralizes that danger.

This invention is based on the principle that fires typically emit both heat and light/infrared radiation simultaneously. Accurate discrimination of excessive levels of these parameters allows initiation of a chain of events ending in the release of a fire suppression agent.

The temperature sensing device has an electrical output proportional in some way to the level of the sensed ambient temperature. In a like manner, the light or infrared radiation sensor has an electrical output proportional to the intensity of the viewed light or infrared radiation. When the ambient conditions drive the sensor outputs beyond normal or typical limits simultaneously, then a condition is realized whereby a stored energy source is called upon to actuate a release mechanism.

Previous stored energy sources for activating fire extinguishers have not been satisfactory since they have been difficult to initiate or activate. Such stored energy sources have also not remained reliable over extended periods of time. It has been unexpectedly determined that chemically stored energy in the form of a solid propellant located within a cartridge similar to the cartridge for a firearm overcomes these problems.

SUMMARY OF THE INVENTION

This invention relates to fire extinguishers and more particularly to fire extinguishers that are automatically activated.

It is an object of the invention to provide fire extinguisher apparatus that is automatically activated by a fire.

It is an object of the invention to provide fire extinguisher apparatus that is reliably activated by a fire.

It is an object of the invention to provide fire extinguisher apparatus that is resistant to false activation.

It is an object of the invention to provide fire extinguisher apparatus that is reliable.

It is also an object of the invention to provide fire extinguisher apparatus that is capable of operation in an unfavorable environment.

It is also an object of the invention to provide fire extinguisher apparatus that is simple in operation.

It is an object of the invention to provide fire extinguisher apparatus that requires very little electrical power.

It is an object of the invention to provide fire extinguisher apparatus that is simple and easy to maintain.

It is an object of the invention to provide fire extinguisher apparatus that has very few moving parts:

It is an object of the invention to provide fire extinguisher apparatus that utilizes chemically stored energy for its activation.

It is an object of the invention to provide fire extinguisher apparatus in which the stored chemical energy remains stable for an extended period of time.

It is an object of the invention to provide fire extinguisher apparatus in which the stored chemical energy is in cartridge form.

It is an object of the invention to provide fire extinguisher apparatus that is capable of continuous monitoring of the local ambient light and temperature levels, without human intervention.

Another object of the invention is to provide fire extinguisher apparatus that compares these levels to established norms.

Another object of the invention is to provide fire extinguisher apparatus that takes positive action to put out a fire when these norms are exceeded by the ambient values.

A further object of the invention is to provide fire extinguisher apparatus with discrimination capabilities such that a fire and only a fire will initiate positive action.

It is also an object of the invention to provide fire extinguisher apparatus that is utilized in connection with commonly used cooking facilities, such as household cooking stoves.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figures 1, 4:
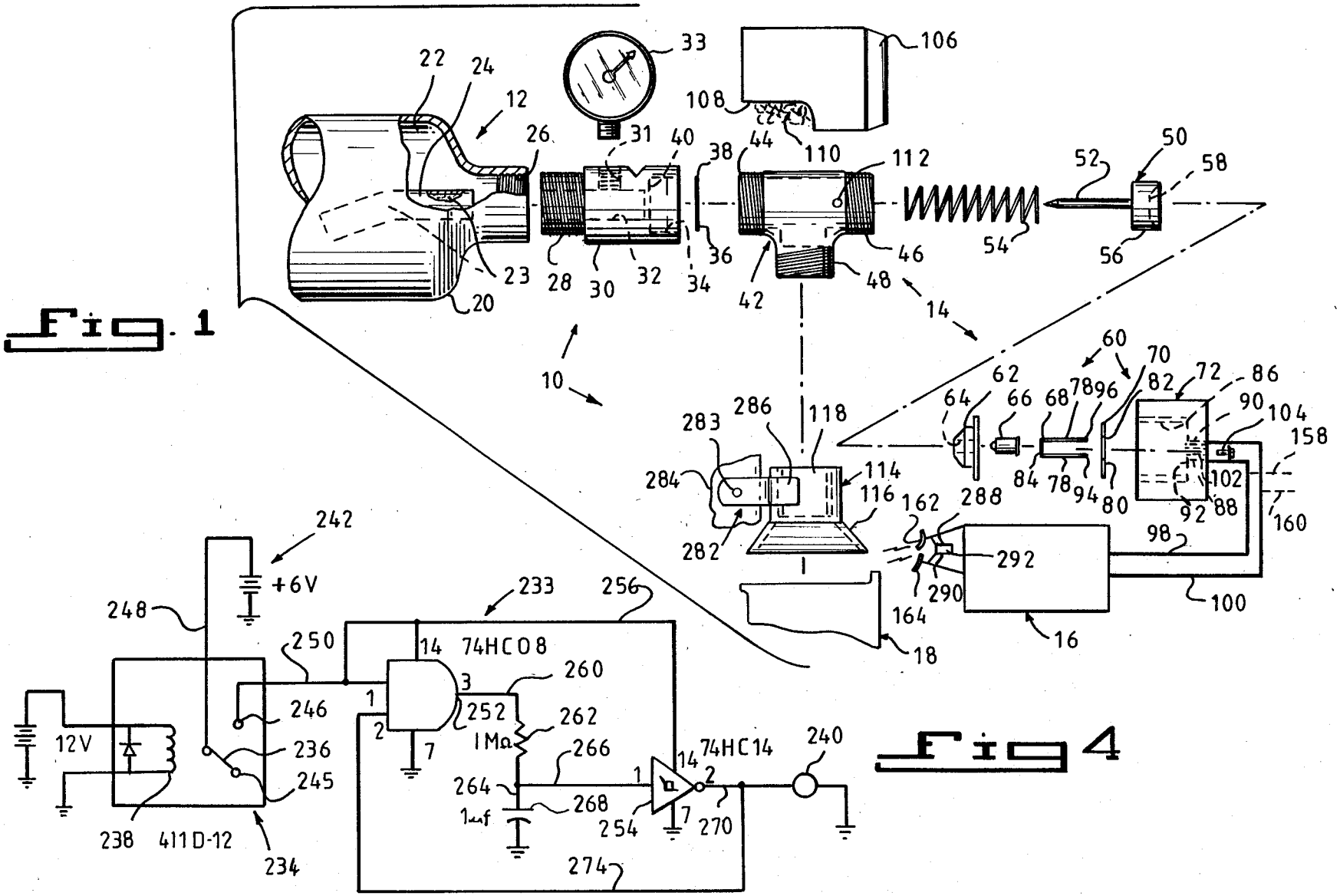
FIG. 1 is an exploded view of the fire extinguisher apparatus invention.
FIG. 4 is a circuit diagram of the power condition indicator that forms part of the invention illustrated in FIGS. 1, 2, and 3.

Referring first to FIG. 1, the cartridge operated fire extinguisher apparatus invention is illustrated and is designated generally by the number 10. The fire extinguisher apparatus 10 comprises fire extinguisher medium storage means for storing a fire extinguisher medium designated generally by the number 12, fire extinguisher medium release means designated generally by the number 14 for releasing the stored fire extinguishing medium that is operatively connected to the storage means 12 and electronic detection and release activation means designated generally by the number 16 for detecting a suspected fire, determining that it is a fire, and activating the fire extinguisher release means 14 if it is a fire. As illustrated, the cartridge operated fire extinguisher apparatus 10 is located in the vicinity of a potential fire which in this case is represented by the kitchen stove designated generally by the number 18.

The fire extinguisher storage means 12 comprises a standard hollow metal fire extinguisher storage bottle 20. The bottle 20 contains a pressurized gas 22 and a fire extinguishing powder 23. The tube 24 provides a passage way for powder 23 that is released with the pressurized gas 22, when the extinguisher is activated. Tube 24 fits tightly within hole 32 as deep as threads 28. The bottle 20 is closed except for the threaded opening 26 located in its end. The threaded opening 26 is sized and shaped to receive the threaded end portion 28 of the bottle adapter and closure fitting 30. The adapter and closure fitting 30 is generally cylindrical shaped and it has a centrally located hole 32 in it with a larger outer threaded portion 34. The adapter and closure fitting 30 also has a side threaded aperture 31 that is adapted to receive the pressure gage 33. A flat metal burst disc 36 is sized and shaped to fit within the outer threaded portion 34 with its outer circumferential portion 38 abutting against the shoulder 40 that is located at the inner end of the threaded portion 34.

The fire extinguisher release means 14 comprises the hollow T-shaped member 42 that has three threaded open ends 44, 46, and 48, the sharp pointed puncture spike member 50 with its cylindrical pointed end portion 52 and connected enlarged head portion 56 with its dished in outer surface 58, and its return coil spring 54 that is sized to fit around the cylindrical portion 52 and the cartridge firing system designated generally by the number 60. The cartridge firing system 60 in turn comprises a generally cylindrical shaped hollow plastic cartridge holder 62 that has a centrally located hole 64 that is sized and shaped to receive the cartridge 66, the U-shaped heater element 68, a plastic disc shaped cartridge holder cover 70 and the generally cylindrical shaped breech block closure member 72.

The cartridge holder 62 has a forward end portion 64 that is sized and shaped to fit in the dished in outer surface 58 of the head portion 56 of the puncture member 50 and the cartridge holder 62 has an enlarged rim portion 76 on its other end that is sized and shaped to abut against the outer surface of the threaded end portion 46 of the T-shaped member 42 when the release means 14 is assembled. The cartridge 66 is a standard commercially available .22 caliber nail driving gun cartridge or alternatively a commercially available .22 caliber blank cartridge can be used. The heater element 68 has two insulated leg portions 78 that fit into holes 80 and 82 in the disc shaped cartridge holder cover 70 that fits over the base portion of the cartridge 66 and the heater element 68 also has an exposed or uninsulated portion 84 that fits tightly against the base of the cartridge 66.

The breech block closure member 72 has a large threaded hole 86 extending partially through it that is sized and shaped to be threaded on the adjacent threaded end portion 46 of the T-shaped member 42. Two apertures 88 and 90 extend through the bottom portion 92 of the breech block closure member 72 and these holes are sized and shaped to receive the insulated leg portions 78 of the heater 68 after they fit through the holes 80 and 82 in the cover 70. The outer end portions 94 and 96 of the heater element 68 that are located adjacent the insulated portions 78 are crimped and soldered to the respective leads 98 and 100 that extend from the electrical detection and release activation means designated generally by the number 16.

A threaded blind hole 102 is located in the center of the outer end of the breech block closure member 72. This hole 102 is adapted to receive the threaded large head screw 104 that is used to locate the flexible plastic shroud 106 in place by the head of the screw 104 pinching the adjacent portion of the shroud 106 against the adjacent portion of the breech block closure member 72. The shroud 106 can be made from a suitable thin piece of plastic and is shaped to fit around the breech clock closure member 72 and as indicated, the shroud 106 has a cut-out 108 that is sized and shaped to fit around a portion of the T-shaped member 42. A fireproof sound suppressing material 110 is located within the shroud and adapted to reduce the sound or noise produced when the cartridge 66 is fired and large amounts of hot gases are produced. It will be noted that these gases are vented into the shroud 106 and the sound suppressing material 110 by the hole 112 that is located in the side of the T-shaped member 42 and another similar hole (not shown) on the other side of the T-shaped member 42.

The fire extinguisher medium release means 14 also comprises a hard plastic discharge nozzle member 114 that has a tapered discharge end portion 116 that is flared outward and located so that its open end points toward the potential source of an unwanted fire which is the cooking stove 18. The end of the nozzle member 114 that is opposite the discharge end portion 116 has an internally threaded aperture 118 that is sized and shaped to be threaded on the threaded open end portion 48 of the T-shaped member 42 so that pressurized gas 22 and fire extinguishing powder 23 that enters the T-shaped member 42 leaves the T-shaped member 42 by the open end portion 48 and the connected discharge nozzle member 114 so that the fire extinguishing medium powder 23 is directed toward the potential source of fire 18.

Figure 2:
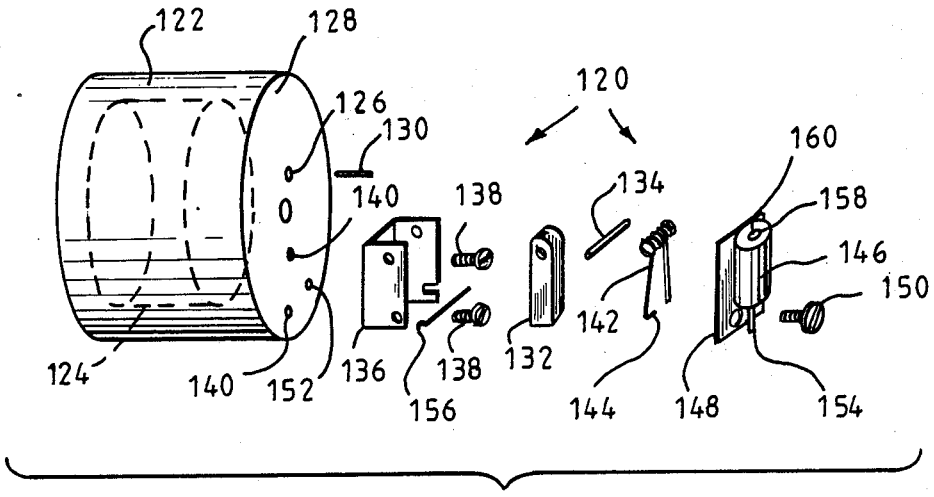
FIG. 2 is an enlarged exploded perspective view of an alternative to a portion of the structure illustrated in FIG. 1.

An alternative to the cartridge firing system designated by the number 60 that is illustrated in FIG. 1 is illustrated in FIG. 2 and is designated generally by the number 120. The cartridge firing system 120 uses the same cartridge holder 62 and cartridge 66 as set forth in FIG. 1, however, the other parts of the system 120 are different than the system 60. The cartridge firing system 120 utilizes a breech block closure member 122 that has a large threaded hole 124 extending partially through it that is sized and shaped to be threaded on to the adjacently located threaded end portion 46 of the T-shaped member 42. A small hole 126 is located in the bottom portion 128 of the breech block closure member 122. This hole 126 is sized and shaped to receive a firing pin 130 that fires the cartridge 66 by denting its rim in a conventional manner.

The firing pin 130 is struck or activated by a pivotally mounted hammer member 132 whose inner end is pivotally mounted on a pivot pin 134 to a hammer mounting member 136 that is secured to the rear face of the breech block closure member 122 by screws 138 that pass through apertures in the mounting member 136 and are threaded into the holes 140. A strong wire compression spring 142 is located in position under the hammer member 132 between the hammer member and the rear face of the breech block closure member 122. A curved tab 144 on the spring 142 fits around a portion of the hammer member 132 and assists in holding the spring 142 in place.

A generally cylindrical shaped electrical solenoid 146 that is commercially available is secured in place on the rear face of the breech block closure member 122 by a bracket 148 that surrounds a portion of the solenoid coil 146 and is secured to the closure member by the screw 150 that fits through a bracket hold and into a threaded hole 152 in the closure member 122. The solenoid 146 acts as a trigger for releasing wire 156 which holds back the spring activated hammer member 132. In this connection, the solenoid 146 has an electrically operated axially movable cylindrical shaped plunger 154 that holds the wire 156, that acts as a lever, over the outer end of the hammer member 132 when the plunger 154 is in its extended or unactivated state and releases the wire 156 that releases hammer member 132 when activated. The solenoid 146 is activated by an electronic signal that comes via the leads 158 and 160 that are electrically connected by leads 98 and 100 to electronic detection and release activation means 16.

As indicated, regardless of whether the cartridge firing system 60 of FIG. 1 or the system 120 of FIG. 2 is used, it is activated by the same release activation means 16 set forth in FIG. 1. The release activation means 16 has the two separate fire characteristic sensors represented by the numbers 162 and 164 that are located in position or pointed toward the potential source of fire 18 to detect two separate characteristics of a fire in a manner that will be hereinafter described in detail.

Figure 3:
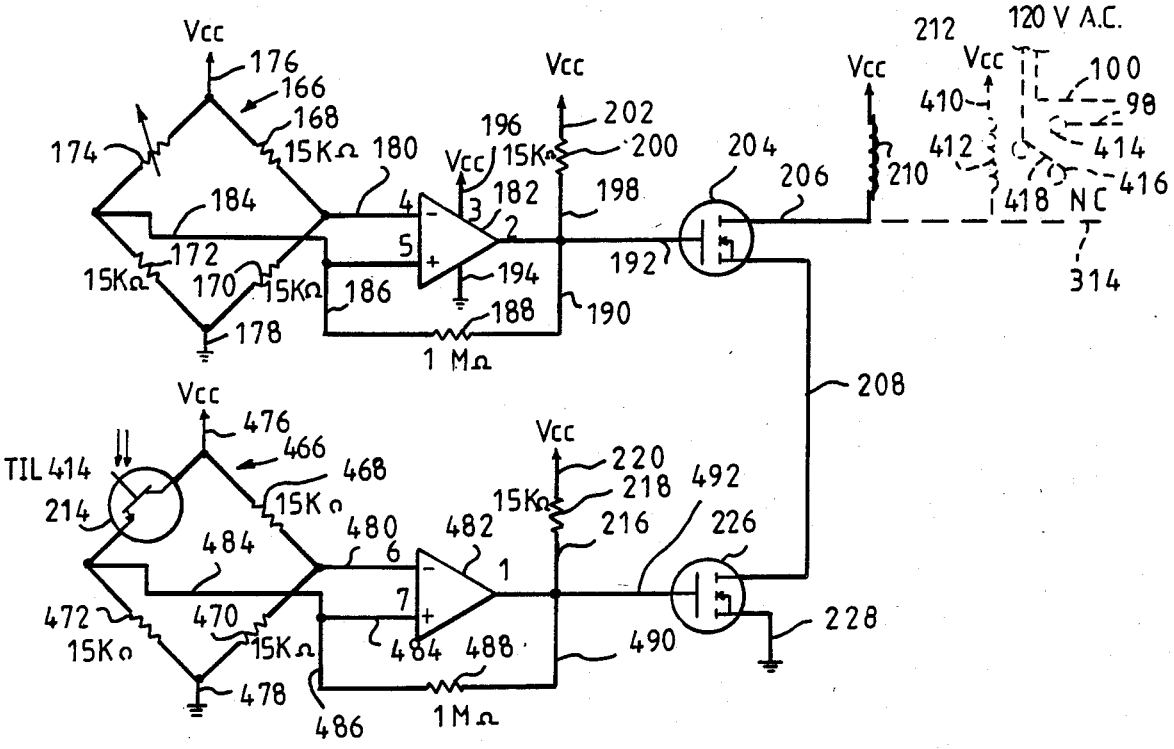
FIG. 3 is a circuit diagram of the electronic detection and activation circuit that forms part of the invention illustrated in FIGS. 1 and 2.

The electronic detection and release activation means 16 is set forth in detail in FIG. 3 and as illustrated it comprises a Wheatstone bridge circuit 166 comprising a fixed 15K ohm resistor 168 that has one end electrically connected to one end of another substantially identically valued fixed resistor 170 that has its other end electrically connected to one end of another substantially identically valued fixed resistor 172. The other end of the fixed resistor 172 is electrically connected to one end of a thermistor 174 whose other end is electrically connected to the other end of the resistor 168. The thermistor 174 is the active component of the fire characteristic sensor or detector 162 illustrated in FIG. 1. In the preferred embodiment the thermistor 174 comprises UUT51J1 UNI-CURVE available from Fenwal Electronics in Framingham, MA. The thermistor 174 is adapted to detect heat emitted from the possible source of fire 18.

The junction of the resistor 168 and the thermistor 174 is electrically connected via the lead 176 to source of positive voltage Vcc of 12 volts DC. The junction of the resistors 170 and 172 is connected via the lead 178 to ground. The junction of the resistors 168 and 170 is connected via the lead 180 to the negative contact 4 of the LM139A comparator 182 that is available from Motorola Semiconductor Products, Inc. of Phoenix, Arizona. The junction of the thermistor 174 and the resistor 172 is connected to the positive contact 5 of the comparator 182 via the lead 184. Contact 5 is also connected to output contact 2 of the comparator 182 via the lead 186, the 1 M ohm resistor 188, and the leads 190 and 192. Contact 12 of the comparator 182 is grounded via the lead 194 and contact 3 is connected to the voltage source Vcc via the lead 196. A lead 198 also connects the lead 192 to the 15 K ohm resistor 200 which is in turn connected by the lead 202 to the voltage source Vcc.

The lead 192 is connected to the gate of the field effect transistor 204. The source of the transistor 204 is connected to the lead 206 and the drain of the transistor 204 is connected to the lead 208. The lead 206 is in turn connected to the solenoid coil 210 that forms part of the solenoid 146 (FIG. 2). The solenoid coil 146 is in turn connected to the positive voltage source Vcc by the lead 212. Alternatively, the lead 206 is connected to the relay coil 412 that forms part of the relay enclosed in 16 located in FIG. 1. The relay coil 412 is in turn connected to the positive voltage source Vcc by the lead 410.

In view of the previously described arrangement set forth in FIG. 3, when the thermistor 174 is exposed to a suitable increase in temperature from the source of fire 18, the resistance of the thermistor 174 decreases and this causes the voltage at contact 5 of the comparator 182 to exceed the voltage at contact 4 of the comparator 182 by a sufficient amount so that a positive voltage Vcc appears at the contact 2 of the comparator 182 and its connected lead 192. This voltage Vcc is also applied to the gate of the transistor 204 and it exceeds the transistor's threshold voltage provided transistor 226 is activated. When this occurs, the transistor 204 is activated. This activation of the transistor 204 in conjunction with transistor 226 creates an electrical path from the lead 206 through the transistor 204 to the lead 208 through the transistor 226 and to the lead 228 which is connected to ground.

The active component of the second detector or sensor 164 of FIG. 1 is designated 214 in FIG. 3 and comprises an infrared detector TIL 414 available from the Tandy Corporation of Fort Worth, Texas. The infrared detector 214 is located in a wheatstone bridge circuit 466 comprising a fixed 15K ohm resistor 468 that has one end electrically connected to one end of a substantially identically valued fixed resistor 470 that has its other end electrically connected to one end of another substantially identically valued fixed resistor 472. The other end of the fixed resistor 472 is electrically connected to the emitter of the infrared detector 214 whose collector is electrically connected to the other end of the resistor 468. The junction of the resistor 468 and the collector of the infrared detector 214 is electrically connected via the lead 476 to the source of positive voltage Vcc of 12 volts DC. The junction of the resistors 470 and 472 is connected via the lead 478 to ground. The junction of the resistors 468 and 470 is connected via the lead 480 to the negative contact 6 of the LM139A comparator 482. The junction of the resistor 472 and the emitter of the infrared detector is connected to the positive lead 7 of the comparator 482 via the lead 484. Contact 7 is also connected to output contact 1 of the comparator via the lead 486, the 1 M ohm resistor 488, and the leads 490 and 492. A lead 216 also connects the lead 492 to the 15K ohm resistor 218 which is in turn connected by the lead 220 to the voltage source Vcc.

The lead 492 is connected to the gate of the field effect transistor 226. The source of the transistor 226 is connected to the lead 208 and the drain of the transistor 226 is connected to the lead 228 which is in turn connected to ground.

The base current of the infrared detector 214 is provided as a result of infrared radiation being received by the infrared detector 214 from the fire source 18. When sufficient infrared radiation is received by the infrared detector 214 it becomes saturated. When this occurs, the infrared detector saturates, causing its resistance to decrease. This causes the voltage at contact 7 of the comparator 482 to exceed the voltage at contact 6 of the comparator 482 by a sufficient amount so that a positive voltage Vcc appears at contact 1 of the comparator 482 and its connected lead 492. This voltage Vcc is also applied to the gate of the transistor 226 and it exceeds the transistor's threshold voltage and hence the transistor 226 is activated. If this occurs when the other transistor 204 is also activated then this provides an electrical path from Vcc through the lead 212 or the lead 410, the coil 210 or the coil 412, the lead 206, the transistor 204, the lead 208, the transistor 226 and the lead 228 to ground which activates the coil 210 or 412.

In the case of the cartridge firing system 120 illustrated in FIG. 2, the activation of the coil 210 results in activation of the solenoid 146. In the case of the cartridge firing system 60 illustrated in FIG. 1, the current through the relay coil 412 switches the relay contact 418 from the normally closed contact 416 to the open terminal 414. This provides the heater element 68 with 120VAC through leads 100 and 98.

As indicated in FIG. 4, power condition indicator means designated generally by the number 233 for providing an indication when electrical power is not being supplied to the fire extinguisher apparatus 10 forms part of the invention 10. The indicator means 233 would be electrically connected to the power source for the invention 10. The relay designated generally by the number 234 and its relay contact 236 is normally energized by the relay coil 238 in the open position and as long as a positive 12 vdc power source voltage is present on the input to the relay coil 238 the contact 236 will remain at this open position. With the relay 234 energized with the relay contact 236 in this open position, the entire remainder of the power condition indicator means circuit 233 will not have any power and electrical power is only supplied to the relay coil 238. In this condition with no electrical power, the light emitting diode 240 will not illuminate since it has no power.

As the 12 volt battery 242 or other power source deteriorates, the relay contact 236 switches from the open position contact 245 to the normally closed terminal 246 due to the fact that electric current in the relay coil 238 decreases. This provides the entire circuit with a voltage of 6 volts that is present on the relay lead 248 and the lead 250 that is connected to the closed terminal 246. As a result, 6 volts are present at terminal 1 of the AND gate 252 and the power plus terminal 14 of the AND gate 252 and the inverter 254 that are connected by the lead 256. The output of the AND gate 252 from the terminal 3 on the lead 260 is initially at a ground potential. This ground potential is present on the resistor 262 and the leads 264 and 266 and the capacitor 268. The inverter 254 reverses this voltage on the lead 266 and the terminal 1 from a ground potential to a positive voltage Vcc on terminal 2 and the lead 270 that is connected to the light emitting diode LED 240. This lights the LED 240 and the positive voltage is fed back to the AND gate by way of lead 274 that is connected to the lead 270.

This results in a change to the output of the AND gate 252 at the terminal 3 on the lead 266 to a positive potential. This charges the 1 mf capacitor 268 to a positive voltage over a 1 second period of time. This positive voltage is presented to the input of the inverter 254 on the lead 266 and the terminal 1. This voltage is inverted to a ground potential on the output of the inverter 254 on terminal 2 and lead 270. The ground potential causes the LED 240 to go out or become nonilluminated. The ground potential is then fed back to the AND gate 252 on the lead 274 that is connected to the lead 270 causing the output of AND gate 252 to be at ground potential. The capacitor 268 then discharges through the resistor 262 and the AND gate 252 and the lead 266 to the inverter 254 in a period of 1 second. This time period is determined by the 1 megaohm resistor 262 and the 1 microfarad capacitor 268 or the RC time constant.

This sequence continues in an oscillating manner and results in on and off flashing of the LED 240 every second. The flashing of the LED 240 gives a visual indication that the power source of the automatic fire extinguisher needs replacing. It must be noted that when this happens all batteries should be replaced. In the preferred embodiment the LED should be a HLMP-4700 available from Hewlett-Packard, Rockville, Maryland and the relay 234 should be a Teledyne relay Series 411D-12 available from Teledyne at Hawthorne, California.

It will, of course, be appreciated that the fire extinguisher apparatus 10 would be located in the vicinity of a potential fire such as that represented by the stove 18. In particular, it is essential that the fire extinguisher medium release means 14 and the sensors or detectors 162 and 164 be located in the vicinity of the stove 18 so that the detectors 162 and 164 can detect a fire and the extinguisher medium release means 14 put the fire out. This can be accomplished by a suitable clamp 282 that is connected by a bolt 283 or the like to the stove hood structure 284 or the like in the vicinity of the stove 18 and has its clamp portion 286 holding the nozzle member 114 so that it points toward the stove 18 and by suitable clamps or connectors or the like 288 and 290 that are connected respectively to the detectors 162 and 164 and stove hood or similar structure 292 so that the detectors point toward the stove.

Figure 5:
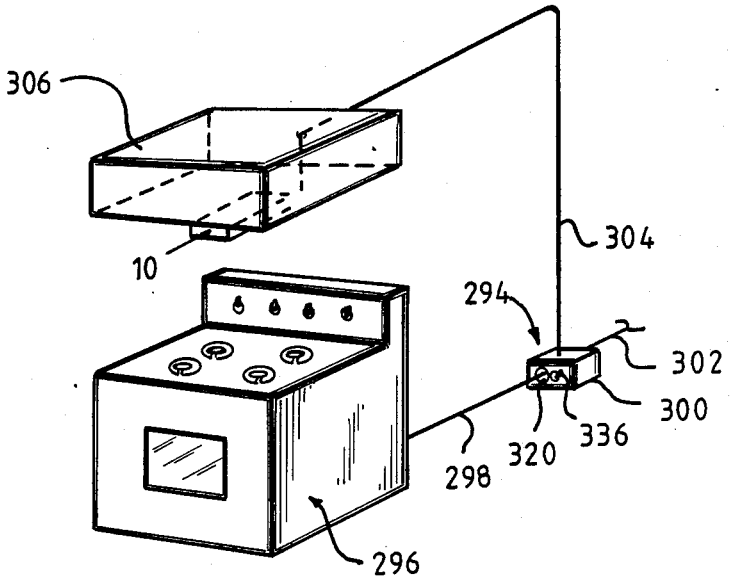
FIG. 5 is a perspective view of an alternative embodiment of the invention illustrated in FIGS. 1 through 4.
Figure 6:
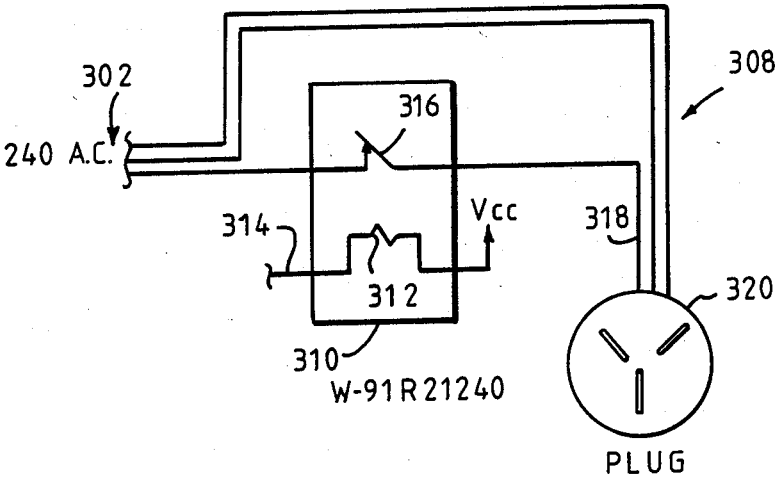
FIG. 6 is a circuit diagram of a portion of the embodiment illustrated in FIG. 5.

FIGS. 5 and 6 illustrate another embodiment of the fire extinguisher apparatus invention 10 which incorporates means or provisions for turning off or disconnecting an electrically operated device or the like when a fire is detected by the invention that is designated generally by the number 294. The electrical disconnecting means 294 is illustrated in use in FIG. 5 in connection with an electrical cooking stove 296 that is similar to that previously represented by the number 18 in FIG. 1. As illustrated, the stove 296 is connected electrically in a conventional manner by an electrical cord 298 to an electrical plug outlet box 300. This outlet box 300 is connected in a conventional manner to the usual 120/220 volt alternating current source of power by the lead 302 and to the previously described fire extinguisher apparatus 10 by the lead 304. It will be noted that the fire extinguisher apparatus 10 illustrated in FIG. 5 is incorporated into a conventional type stove fume hood 306 that is conventionally located above the stove 296.

The electronic circuit 308 that forms part of the disconnecting means 294 illustrated in FIG. 5 is set forth in FIG. 6. As illustrated, the circuit 308 comprises a magnetic hydraulic relay trip circuit breaker 310 that is available from Potter Brumfield of Princeton, Indiana with a coil 312 that has one terminal connected to a source of voltage Vcc and the other terminal connected by the lead 314 to the lead 206 illustrated in FIG. 3. The power lead 302 is connected to the relay switch 316 that is normally closed and hence is in contact with the lead 318 that goes to the plug outlet 320 that is in turn usually connected to the stove by the lead 298 as illustrated in FIG. 5.

In view of the circuit set forth in FIG. 6, power is normally supplied to the plug 320 by the power lead 302, the closed circuit breaker switch 316, and the lead 318. When a fire is detected and confirmed as previously indicated lead 206 in FIG. 3 is essentially grounded through transistors 204 and 226. Lead 314 an extension of lead 206 in FIG. 3 and FIG. 6 is also grounded. The relay trip circuit in the magnetic hydraulic circuit breaker will trip as a result of the ground potential present on lead 314 energizing the coil 312 via the positive potential Vcc coil 312 and lead 314. This causes the circuit breaker switch 316 to move to its open position that interrupts the circuit between the leads 302 and 318 and hence interrupts power to the plug 320. This shuts off any device such as the stove 296 that is connected to the plug 320. In order to reset the circuit or disconnection means 294, the toggle switch 336 on the outlet box 300 is flipped. This restores power to the plug 320 and any connected electrical device.

In the preferred embodiment illustrated in FIGS. 5 and 6, the magnetic-hydraulic relay trip circuit breaker 310 will be located in the outlet box 300 along with the associated leads. The magnetic hydraulic relay trip circuit breaker 310 can be a W-91R21240 available from Potter and Brumfield of Princeton, Indiana, and can be mounted inside the outlet box 300. The outlet box 300 is conventional in nature except that is has provisions for the reset toggle switch 336. This arrangement permits the fire extinguisher apparatus 10 of FIGS. 1 through 4 to be converted or retrofitted to provide the electrical disconnection means 294 of FIGS. 5 and 6 whenever it is desired.

The cartridge operated fire extinguisher apparatus 10 is made and used in the following manner. As previously indicated, the storage bottle 20 is a standard 10 BC size and is available commercially from numerous sources known in the art. The adapter and closure fitting can be machined from low carbon steel or brass in a manner known in the art. The burst disk 36 is made by being stamped from a suitable hard temper aluminum sheet known in the art and in the preferred embodiment it is substantially 0.0010 of an inch thick. The hollow T-shaped member 42 comprises a standard ¾ inch pipe tee with two holes such as the hole 112 and another oppositely located similar hole (not shown) drilled through its walls. The pressure gage 33 is a standard pressure gage for fire extinguishers that is known in the art. The nozzle member 114 is molded from a suitable hard plastic in a manner known in the art. The bracket 282 is stamped from a suitable spring steel and is formed in a conventional manner known in the art as are the clamps or holders 288 and 290.

The pointed puncture spike member 50 is machined in a conventional manner from low carbon steel and the spring 54 is available from numerous sources known in the art. The breech block closure member 72 is also machined in a conventional manner from low carbon steel as is the member 122. The cartridge holder 62 is molded from a fiber reinforced plastic and the disc shaped cartridge holder cover 70 is also made from a suitable hard plastic in a manner known in the art. The U-shaped heater element 68 is conventionally made from 0.015 inch nichrome or similar wire. The shroud 106 is also cut in a manner known in the art from a flexible plastic sheet and fine steel wool has been used for the sound suppressing material 110.

The firing pin 130 and the hammer member 132 are machined in a conventional manner from low carbon steel in a manner known to those skilled in the art. The spring 142 is also made in a conventional manner from suitable spring steel. The electronic circuits illustrated in FIGS. 3, 4, and 6 that form part of the fire extinguisher invention 10 are constructed in the previously indicated manner and in a manner known to those skilled in the art.

The cartridge operated fire extinguisher is assembled by first putting the fire extinguishing medium comprising powder 23 in tube 24 into the interior of the bottle 20. The adapter and closure fitting 30 is then screwed into the fitting 42 and this firmly secures the disc 36 in place. The bottle 20 is also filled in a conventional manner with compressed gas 22 when the bottle 20 is closed by the closure fitting 30. The nozzle member 114 is also located on the T-shaped member 42 by threading the aperture 118 into the threaded end 48.

The spring 54 is then inserted into the open end 46 of the T-shaped member 42 as is the spike member 50 with the pointed end portion 52 located in the center opening in the spring 54. It will be noted that the spring 54 keeps the pointed end portion 52 away from the disc 36. Next the cartridge firing system 60 illustrated in FIG. 1 or the cartridge firing system 120 illustrated in FIG. 2 is secured in place on the T-shaped discharge member 42. This is accomplished by screwing the breech block closure member 72 or 122 onto the threaded open end portion 46 of the T-shaped member 42. However, prior to doing this, the cartridge holder 62 and the cartridge 66 are inserted into the open end portion 46. In the case of the cartridge firing system 60, the heater wire 68 and the insulating cover disc 70 are also located inside the breech block closure member prior to it being secured to the open end portion 46.

Next, the cartridge firing system 60 or the cartridge firing system 120 whichever is used, would be connected electrically to the detection and release activation means 16 by connecting the leads 98 and 100 to the ends 94 and 96 of the heater element 68 in the case of the firing system 60 and by connecting the solenoid 146 leads 158 and 160 to the leads 98 and 100 in the case of the firing system 120. In the case of the firing system 120, the solenoid 146 and the hammer member 132 and the associated spring 142 are previously attached to the breech block closure member 122 as previously indicated. Then the shroud 106 with the sound suppressing material 110 inside it is attached to the breech block closure member 72 or 122.

The fire extinguisher apparatus 10 is located in the vicinity of the stove 18 through the use of the clamp 282 and the connectors 288 and 290. It should be noted that the battery or batteries 242, if any, and associated power indicator circuit 233 that are used to provide electric power to the electronic detection and release activation means 16 will be located physically close to the electronic detection and release activation means 16. If the disconnecting means 294 of FIGS. 5 and 6 is also used it would be also suitably located as previously described in connection with FIG. 5 and would be electrically connected to the leads 98 and 100 as previously indicated.

As previously indicated, when the cartridge operated fire extinguisher apparatus invention 10 is in use, heat alone or visible radiation alone will not activate the electronic detection and release activation means 16 since only one of the detectors 162 or 164 will be activated. However, if both the proper type of light radiation and heat are present then both detectors 162 and 164 will be activated and this will result in a proper electrical current being sent to the cartridge firing system 60 or 120 and this will result in the firing of the cartridge 66 by heat in the case of the firing system 60 and by impact in the case of the firing system 120 since the solenoid 146 is activated and its plunger 154 withdrawn that releases the hammer member 132 that strikes the firing pin 130 due to the force exerted by the spring 142.

When this occurs, gas from the fired cartridge strikes the head 56 of the spike member 50 and causes its pointed end portion 52 to pierce the disc 36 which releases the gas 22 and the fire extinguishing medium 24. The sound suppressing medium 110 reduces the noise when the cartridge 66 is fired. The spring 54 returns the spike member 50 to its outward position after the force from the gas from the cartridge 66 is no longer present on the head portion 56. The gas 22 and fire extinguishing medium 24 then leaves the nozzle member 114 after passing through the T-shaped member 42 and it strikes the fire on the stove 18 or 296 and puts out the fire. If the disconnecting means 294 is used the stove 296 or other electrical device will also be shut off from the same signal that fires the cartridge 66 in the previously indicated manner.

After use, the cartridge operated fire extinguisher apparatus 10 can be prepared for reuse by disassembling it by reversing the previously described assembly procedure and then cleaning it and reassembling it with a new gas 22 charge and fire extinguishing medium 24 charge and a new unfired cartridge 66. Of course, any damaged components such as the firing pin 130 or the spike member 50 would be replaced prior to reassembly. In addition, the disconnecting means 294 can be reset using the reset button 336.

If the battery or batteries should deteriorate or if another power source should fail, then the L.E.D. would light and go out at intervals until the batteries 242 were replaced or the power was restored. This flashing light from the L.E.D. provides a readily visible indication that the fire extinguishing apparatus 10 may not function properly.

The use of the cartridge 66 results in a fire extinguisher apparatus 10 that is exceptionally reliable and is very easy to service. This is true since the cartridge 66 provides a very powerful activation force and in addition a cartridge 66 has an extremely long storage life which can be some twenty to thirty years or more. Indeed, cartridges such as the cartridge 66 have been successfully fired some fifty years after they have been manufactured. All that is required to service the cartridge activated fire extinguisher apparatus 10 is to periodically change any batteries 242 and check the pressure gage 33. In addition, after years of use the spring 142 should be replaced if it is used.

Although this invention has been described in considerable detail with reference to certain preferred embodiments, it will be understood that variations and modifications may be made to the invention within the spirit and scope of the appended claims.

What is claimed is:

1. Fire extinguisher apparatus comprising: fire extinguisher medium storing means for storing a fire extinguishing medium; fire extinguisher medium release means operatively connected to said fire extinguisher medium storing means for releasing the fire extinguishing medium from said fire extinguisher medium storing means, said fire extinguisher medium release means comprising a replaceable propellant cartridge and means located external to said replaceable propellant cartridge for activating said replaceable propellant cartridge; electronic detection and release activation means operatively connected to said fire extinguisher medium release means for detecting a suspected fire, determining that it is a fire and activating said fire extinguisher medium release means, said electronic detection and release activation means comprising a thermal detector, a light detector and electronic activating means connected to said thermal detector and said light detector for preventing activation of said fire extinguisher medium release means until both said thermal detector and said light detector are activated; and an independent source of power for said fire extinguisher apparatus comprising a battery operatively connected to said electronic detection and release activation means and battery indicator means associated with said battery for indicating when said battery needs replacing.

2. The fire extinguisher apparatus of claim 1 wherein said battery indicator means comprises means for emitting a flashing light when said battery needs replacing.

3. Fire extinguisher apparatus comprising: fire extinguisher medium storing means for storing a fire extinguishing medium; fire extinguisher medium release means operatively connected to said fire extinguisher medium storing means for releasing the fire extinguishing medium from said fire extinguisher medium storing means, said fire extinguisher medium release means comprising a replaceable propellant cartridge, an enclosure for said replaceable propellant cartridge having a vent for gases from said replaceable propellant cartridge when the cartridge is fired, sound suppressing means located adjacent to the vent of said enclosure for reducing noise when said replaceable propellant cartridge is fired and means located external to said cartridge for activating said replaceable propellant cartridge; and electronic detection and release activation means operatively connected to said fire extinguisher medium release means for detecting a suspected fire, determining that it is a fire and activating said fire extinguisher medium release means, said electronic detection and release activation means comprising a thermal detector, a light detector and electronic activating means connected to said thermal detector and said light detector for preventing activation of said fire extinguisher medium release means until both said thermal detector and said light detector are activated.

4. The fire extinguisher apparatus of claim 3 further comprising a hollow plastic cartridge holder located within said enclosure for said replaceable propellant cartridge for holding said replaceable propellant cartridge.

5. The fire extinguisher apparatus of claim 4 wherein said replaceable cartridge has a base portion and further comprising a plastic cover positioned to fit over the base portion of said cartridge.

6. The fire extinguisher apparatus of claim 3 wherein said means for activating said replaceable cartridge comprises a firing pin and spring activated means for causing said firing pin to fire said replaceable cartridge.

7. The fire extinguisher apparatus of claim 6 wherein said spring activated means for causing said firing pin to fire said replaceable cartridge further comprises a solenoid and a lever positioned to be activated by said solenoid.

8. The fire extinguisher apparatus of claim 3 further comprising means connected to said thermal detector and to said light detector for locating said thermal detector and said light detector in the vicinity of a stove.

* * * * *